US007754989B2

(12) United States Patent
Wong

(10) Patent No.: US 7,754,989 B2
(45) Date of Patent: Jul. 13, 2010

(54) ELECTRICAL SWITCH

(75) Inventor: Kin Yu Wong, Hong Kong SAR (CN)

(73) Assignee: Defond Components Limited, Hong Kong SAR (CN)

( * ) Notice: Subject to any disclaimer, the term of this patent is extended or adjusted under 35 U.S.C. 154(b) by 125 days.

(21) Appl. No.: 11/959,782

(22) Filed: Dec. 19, 2007

(65) Prior Publication Data

US 2008/0156627 A1 Jul. 3, 2008

Related U.S. Application Data

(60) Provisional application No. 60/882,251, filed on Dec. 28, 2006.

(51) Int. Cl.
*H01H 5/06* (2006.01)

(52) U.S. Cl. ..... 200/454; 200/522; 200/450

(58) Field of Classification Search ..... 200/1 B, 200/34, 35 H, 38 C, 293.1, 318.1, 318.2, 200/332.2, 424–470, 522, 409, 427; 267/70, 267/171, 173, 179

See application file for complete search history.

(56) References Cited

U.S. PATENT DOCUMENTS 1,986,221 A * 1/1935 Sachs ..... 200/50.1
2,283,509 A * 5/1942 Peterson ..... 200/457
3,046,377 A * 7/1962 Fraser ..... 200/455
3,312,801 A 4/1967 Schleicher
3,542,975 A * 11/1970 Walterick ..... 200/5 F
4,095,067 A * 6/1978 LaScola ..... 200/455
4,121,069 A 10/1978 Long
4,385,754 A * 5/1983 Waite ..... 267/71
4,528,431 A * 7/1985 Coleman, III ..... 200/408
4,692,572 A * 9/1987 Heath ..... 200/17 R
4,973,030 A * 11/1990 Leonard ..... 267/71
6,635,972 B1 * 10/2003 Barthel et al. ..... 307/9.1
6,727,450 B2 * 4/2004 Schaeffeler et al. ..... 200/522
6,784,390 B2 * 8/2004 Chu ..... 200/522
6,791,038 B1 * 9/2004 Lai ..... 200/16 A
6,919,523 B1 * 7/2005 Lai ..... 200/402
7,186,940 B1 * 3/2007 Wong ..... 200/537
7,468,492 B2 * 12/2008 Lai ..... 200/43.16

* cited by examiner

*Primary Examiner*—Renee S Luebke
*Assistant Examiner*—Lisa Klaus
(74) *Attorney, Agent, or Firm*—Leydig, Voit & Mayer, Ltd.

(57) ABSTRACT

An electrical switch has a fixed contact and a moving contact arranged for movement between an ON position in contact with the fixed contact and an OFF position out of contact with the fixed contact, and an operating member for operating the moving contact. A spring co-acts between the operating member and the moving contact and resiliently biases the moving contact towards each of the ON and OFF positions through an over-centre action of the spring. An end piece is fitted at each end of the spring, which has a formation, for example, a groove, for pure rotary engagement with a part, for example, a pin, movable with the operating member or moving contact for imparting resilient action upon the operating member or the moving contact.

4 Claims, 3 Drawing Sheets

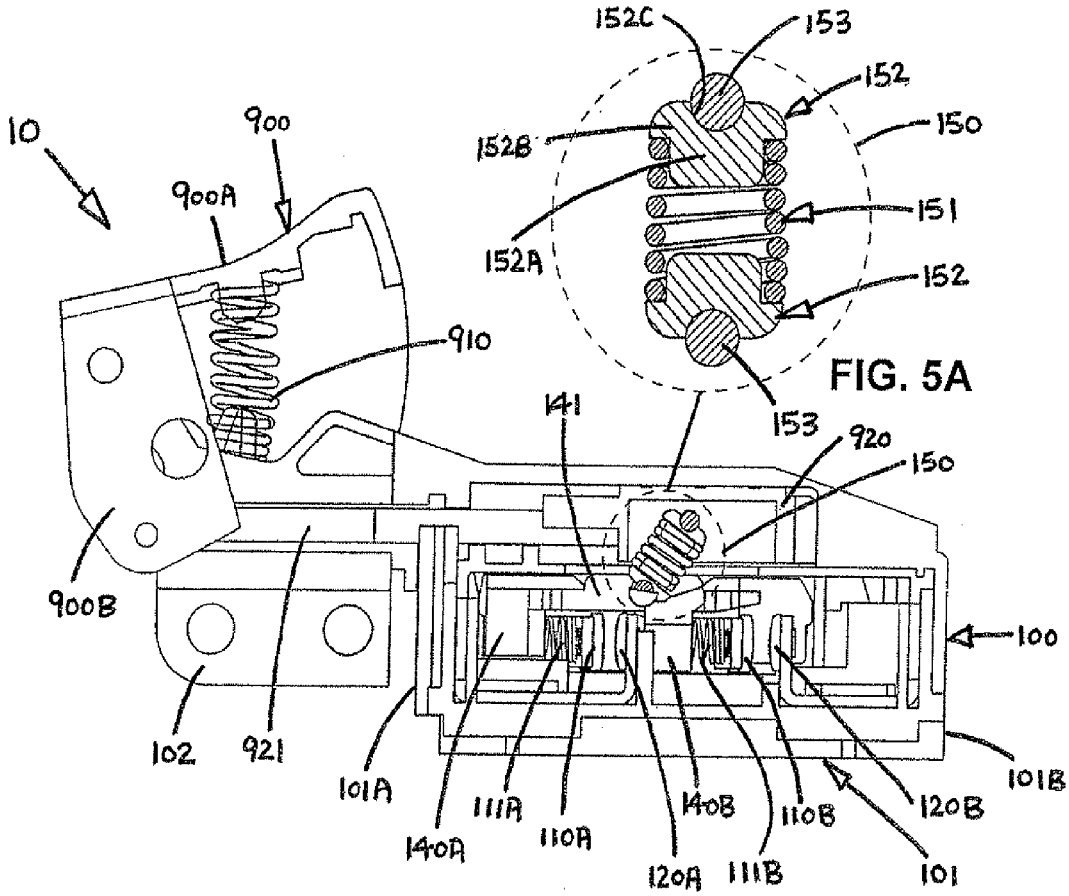
FIG. 5A
FIG. 5
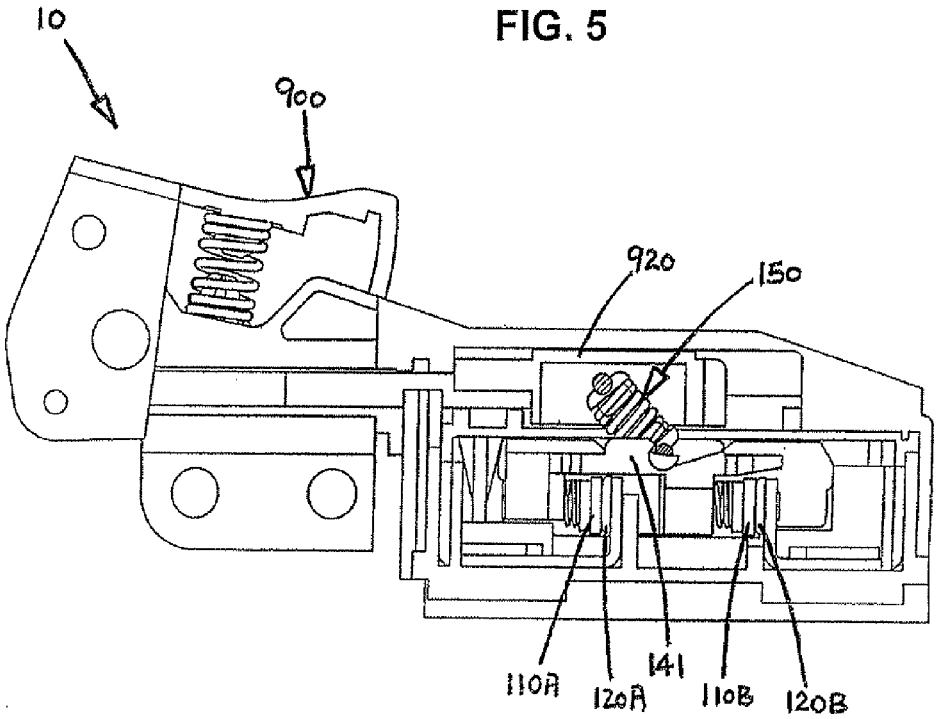
FIG. 6

ELECTRICAL SWITCH

The present invention relates to an electrical switch or switch assembly for controlling the operation of an electrical appliance such as a power tool and in particular a circular saw.

BACKGROUND OF THE INVENTION

Electrical switches especially those for controlling the operation of power tools are designed with care and precision and must meet a variety of official standards and requirements on, inter alia, performance, safety and durability.

The invention seeks to provide a new or otherwise improved electrical switch assembly that is relatively more durable and yet remains functional viable and safe.

SUMMARY OF THE INVENTION

According to the invention, there is provided an electrical switch comprising:

a body;

at least one fixed contact and a moving contact supported by the body and arranged for movement between a first (ON) position in contact with said at least one fixed contact and a second (OFF) position out of contact with said at least one fixed contact;

an operating member for operating the moving contact by moving the moving contact between the first and the second positions;

a spring having opposite ends and co-acting between the operating member and the moving contact and resiliently biasing the moving contact towards each of the first and the second positions through an over-centre action of the spring; and a distinct end piece provided at least one end of the spring, the end piece being attached to the end of the spring and having a formation adapted for pure rotary engagement with a part movable with the operating member or moving contact for imparting resilient action upon said operating member or moving contact.

Preferably, the spring has a straight central axis and remains substantially straight at all time.

In a preferred embodiment, the formation has an at least part-circular cross-section in engagement with the part for pure rotary action about the part.

More preferably, the formation comprises a groove having a cross-section that is part-circular.

It is preferred that the part has a cross-section complementary to that of the formation for engagement by the formation.

It is further preferred that the formation comprises a groove having a cross-section that is part-circular, and the part comprises a pin having a circular cross-section.

In a preferred embodiment, the spring comprises a helical coil spring.

In a preferred embodiment, the end piece has a head including the formation and a stem extending from the head and fixed into the end of the spring.

In a preferred embodiment, the operating member and the moving contact include respective sliders for interaction between which the spring co-acts, the sliders being slidable linearly in substantially parallel directions with the spring extending across the sliders.

BRIEF DESCRIPTION OF DRAWINGS

The invention will now be more particularly described, by way of example only, with reference to the accompanying drawings, in which:

FIG. 5 is a cross-sectional side view of the switch of FIG. 3;

FIG. 5A is a cross-sectional side view of a coil spring unit of the switch of FIG. 5; and FIG. 6 is a cross-sectional side view of the switch of FIG. 4.

DETAILED DESCRIPTION OF PREFERRED EMBODIMENT

Figure 1:
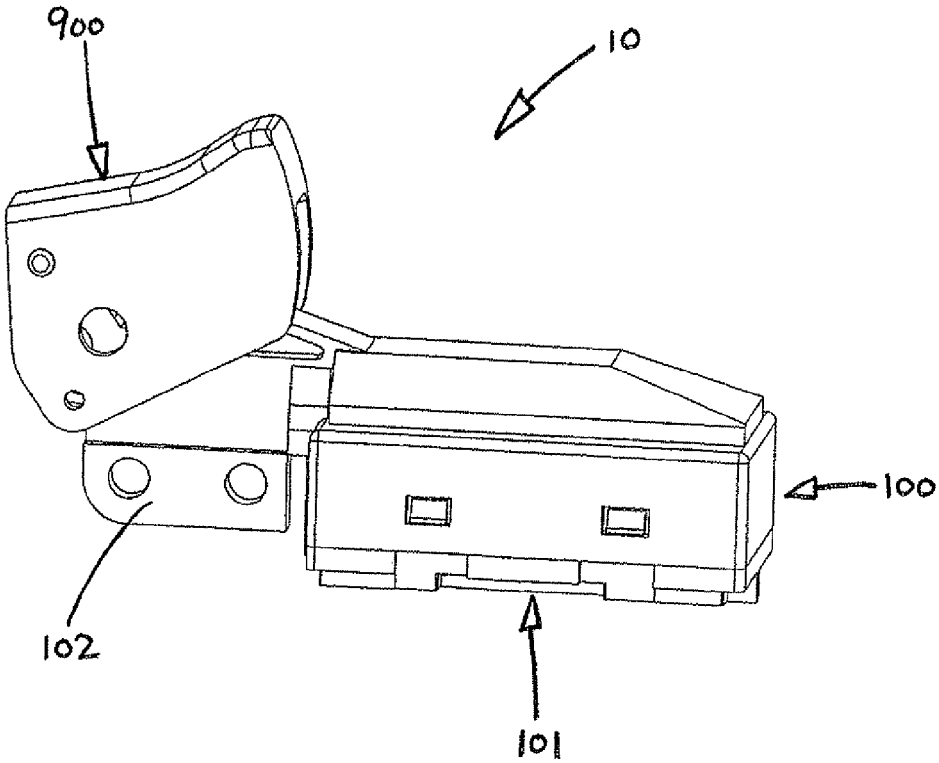
FIG. 1 is a side perspective view of an embodiment of an electrical switch in accordance with the invention.
Figure 2:
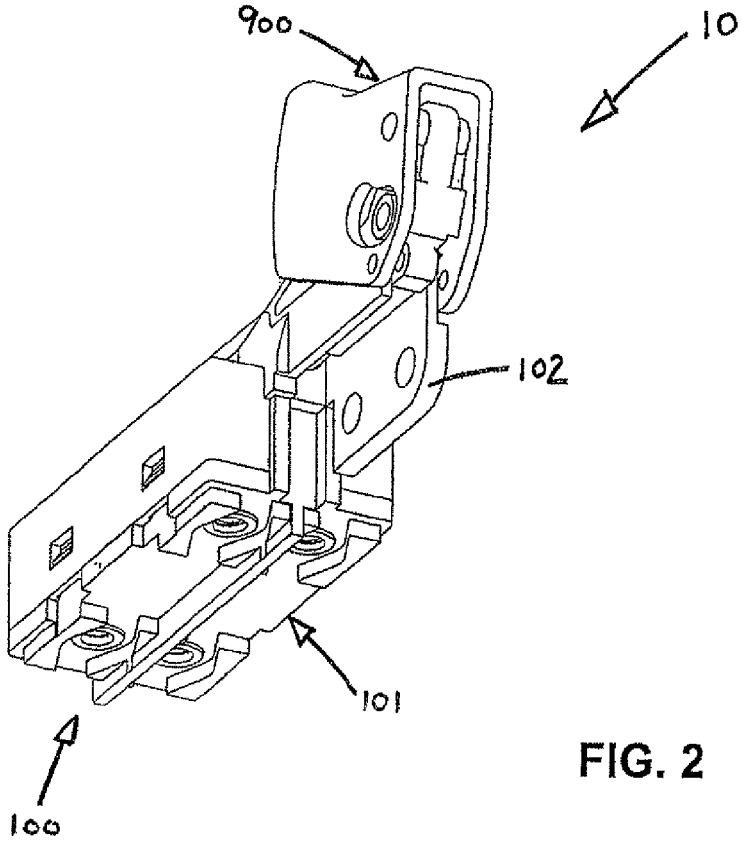
FIG. 2 is a rear perspective view of the switch of FIG. 1.
Figure 3:
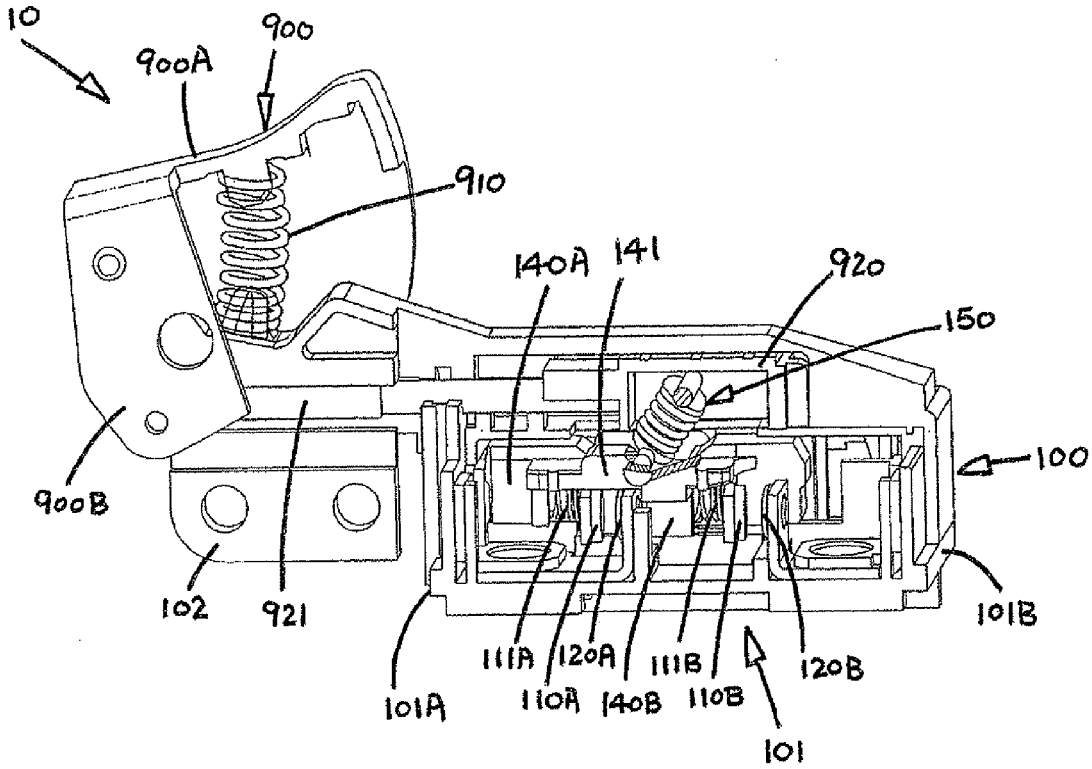
FIG. 3 is a partially-broken side perspective view of the switch of FIG. 1, showing the switch in a normal switch-off condition.
Figure 4:
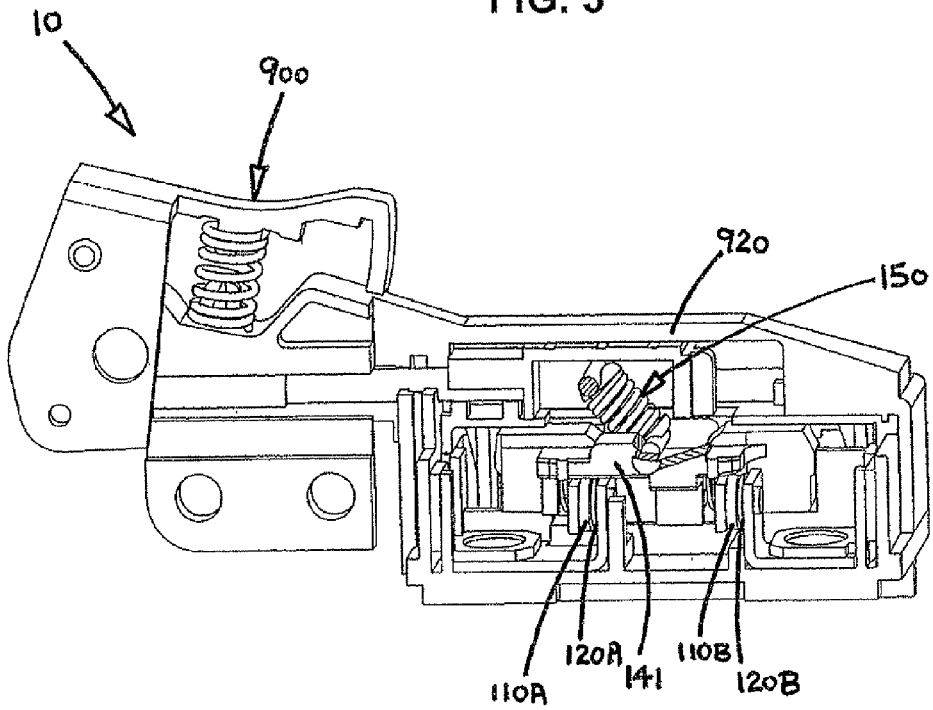
FIG. 4 is a partially-broken side perspective view similar to FIG. 3, showing the switch in an activated switch-on condition.

Referring to the drawings, there is shown an electrical switch 10 embodying the invention, which has a base 100 and a trigger 900 pivotable thereon. The base 100 includes a generally rectangular oblong casing 101 shown lying horizontally, which has opposite front and rear end portions 101A and 101B. The trigger 900 has an inner part 900B which is hinged by a hinge pin to a hinge support 102 that protrudes lengthwise from the front casing end portion 101A and an outer part 900A for pressing/pulling by a user's finger.

An internal coil spring 910 compressed between the trigger 900 and the hinge support 102 resiliently biases the trigger 900 outwards about the hinge support 102 (FIG. 5). In operation, the trigger 900 may be pressed inwards against the action of the spring 910 (FIG. 6) and it will, upon release, be flipped by the spring 910 back to its original outer position (FIG. 5).

A first pair of opposed left and right fixed contacts 120A and a moving contact bar 110A are arranged inside the front end portion 101A of the base casing 101, and a second pair of opposed left and right fixed contacts 120B and a moving contact bar 110B inside the base casing's rear end portion 101B. In either case, the moving contact bar 110A/110B extends across the associated fixed contacts 120A/120B, spaced at a small distance apart therefrom at the front, for moving forward to make contact with both fixed contacts 120A/120B (i.e. switch-on condition of FIG. 6) or moving backward to break contact therewith (i.e. switch-off condition of FIG. 5), thereby switching on and off an electrical appliance controlled by the switch assembly 10, such as a circular saw.

The moving contact bars 110A and 10B are transported by respective carriers 140A and 140B which are slidable in unison, in opposite directions, longitudinally of the base casing 101. Both carriers 140A and 140B are connected to, or otherwise formed integrally with, an upper horizontal bracket 141 for simultaneous movement thereby when the bracket 141 is actuated.

Each carrier 140A/140B presents an inclined surface supporting the corresponding moving contact bar 110A/110B from the front under the action of a coil spring 111A/111B acting against the moving contact bar 110A/110B from behind. The arrangement is such that the moving contact bar 110A/110B will be moved into contact with the associated fixed contacts 120A/120B one after the other (e.g. the fixed contact on the left side first and then the other contact on the right side) and that it will be moved out of contact with the fixed contacts 120A/120B in the reversed order (i.e. the fixed contact on the right side first and then the other contact on the left side).

This ensures that each fixed contact that actually breaks the relevant inductive/motor circuit (i.e. the right side fixed contact in the example) can be built more robust and resistant to contact flashover, arcing or welding.

The carriers 140A and 140B are moved via the bracket 141 by means of an oblong slider 920 which is linked to the trigger 900 by an actuating rod 921. The rod 921 has a front end pivotably connected to the inner part 900B of the trigger 900 at an eccentric position from the aforesaid hinge pin, with its rear end connected to the slider 920, such that as the trigger 900 is pivoted and released the rod 921 and hence the slider 920 are slid simultaneously back and forth.

The slider 920 (together with the rod 921) is slidable along a linear path longitudinally of the base casing 101 in either direction parallel to that of the sliding motion of the bracket 141, which controls the moving contact bars 110A and 110B. The slider 920 is positioned right above the bracket 141, between which an over-center spring unit 150 is provided.

The trigger 900 and moving contact bars 110A and 110B interact via the slider 920 and bracket 141 respectively, which are slidable linearly in substantially parallel directions with the spring unit 150 extending across them.

The spring unit 150 is maintained compressed at all times, and it goes rapidly past a condition/position of maximum strain, i.e. a "center" condition, as the slider 920 is slid (by the trigger 900) from one end to the other end of its path of movement to thereby flick or eject, through an over-center action, the bracket 141 (and hence the moving contact bars 110A and 110B) rapidly in the opposite direction. This makes a non-teasible mechanism which assures that switching will either take place or not occur, without there being any uncertain intermediate condition.

The spring unit 150 is provided by a straight helical coil spring 151 whose opposite ends are fitted or attached with respective mushroom-like end pieces 152. Each end piece 152 is a distinct member, having a stem 152A that is press-fitted co-axially into the corresponding end of the spring 151 and a head 152B which covers the end of the spring 151 and in which a linear central groove 152C having a semi-circular cross-section is formed, extending diametrically across the outer surface of the head 152B.

The stem 152A of each end piece 152 extends internally over about one-third of the length of the spring 151, together occupying about two-thirds of the spring's length. In particular, the two stems 152A will reach close to each other, within two turns at most, when the spring 151 is in action momentarily at its maximum strained "centre" condition.

The end pieces 152 act as spring holders that hold the spring 151 in place between the slider 920 and the bracket 141. The end pieces 152 also serve as an agent for the spring 151 to act or impart resilient action upon the slider 920 and the bracket 141 by way of a pivotal engagement that permits a pure rotary or turning action. The slider 920 and the bracket 141 are provided with or include respective co-parallel horizontal bearing pins 153, with which the two end pieces 152 bear and engage by their grooves 152C respectively such that the spring 151 is compressed between the two pins 153 to act in opposite directions upon the slider 920 and the bracket 141.

The groove 152C of each end piece 152 matches with the corresponding pin 153 in terms of diameter, i.e. having complementary cross-sections, such that the end piece 152 is free to turn or pivot about the pin 153 in a smooth and steady manner and there can be no slip or obstruction. The spring 151, both end pieces 152 and the pins 153 are centrally aligned on the same imaginary plane that contains all their central axes.

Such a design and arrangement ensure that the spring 151 assumes a straight configuration (i.e. having a straight central axis) and will remain substantially straight at all times throughout the interaction between the slider 920 (i.e. the trigger 900) and the bracket 141 (i.e. the carriers 140A/140B or moving contact bars 110A/110B). The spring 151 will only be subject to compression in the direction of its central axis and will therefore contract and expand linearly, without being bent or twisted by any eccentric or angular force or torque that is avoided or absent.

In particular, the spring 151 will only contract and expand linearly along its central axis as it pivots while the slider 920 flicks the bracket 141/carriers 140A and 140B to the opposite side through an over-center action, and the spring 151 will stay straight in the resulting switch-on or switch-off condition.

By utilizing this concept in construction, the over-center spring unit 150 can operate over 500,000 times without noticeable damage or failure, compared with about only 100,000 times as is generally known in the art for the pre-existing over-center flip spring systems, in which the spring bends.

It is envisaged that the pins 153 may be replaced by integral edges or ribs of the slider 920 and bracket 141, or the pins 153 may be fixed to or integrally formed on the corresponding spring end pieces 152 in which case such pins 153 should hingedly engage with the slider 920 and bracket 141.

The invention has been given by way of example only, and various other modifications of and/or alterations to the described embodiments may be made by persons skilled in the art without departing from the scope of the invention.

The invention claimed is:

1. An electrical switch comprising:

a body;

a fixed contact supported by the body;

a moving contact bar slidably supported by the body for linear sliding within the body;

a contact mounted on the contact bar and movable with the contact bar between a first position, in contact with the fixed contact, and a second position, out of contact with the fixed contact;

a slider, partially disposed within the body, sliding linearly, substantially parallel to the moving contact bar, and including a first pin extending from the slider, transverse to the direction of sliding of the slider;

a bracket linking the slider and the moving contact bar, sliding the moving contact bar in response to sliding of the slider, and including a second pin protruding from and transverse to the bracket and substantially parallel to the first pin; and a spring unit selectively resiliently biasing the moving contact toward the first position and toward the second position and including a helical spring having a linear central axis and opposed first and second ends, and first and second end pieces respectively attached to the first and second ends of the helical spring, each of the first and second end pieces including a stem coaxial with and frictionally engaging the helical spring at the respective end and a head covering the respective end of the helical spring, each head including a linear groove having an axis transverse to the central axis of the helical spring and extending diametrically across the head of the respective end piece, wherein the first pin is received within the groove of the first end piece for rotation of the first end piece relative to the first pin, and the second pin is received within the groove of the second end piece for rotation of the second end piece relative to the second pin.

2. The electrical switch as claimed in claim 1, wherein the central axis of the helical spring is substantially straight when the moving contact is in the first position, in the second position, and in intermediate positions between the first and second positions.

3. The electrical switch as claimed in claim 1, wherein the first and second pins have circular cross-sections.

4. The electrical switch as claimed in claim 3, wherein each of the grooves in the first and second end pieces has a surface that is, in cross-section, partially circular.

* * * * *